US008475148B2

(12) United States Patent
Iitsuka et al.

(10) Patent No.: US 8,475,148 B2
(45) Date of Patent: Jul. 2, 2013

(54) SCROLL COMPRESSOR HAVING THROUGH HOLES WITH A SET DEPTH

(75) Inventors: Satoshi Iitsuka, Ota (JP); Kazuyoshi Sugimoto, Oizumi-machi (JP)

(73) Assignee: SANYO Electric Co., Ltd., Moriguchi, Osaka (JP)

( * ) Notice: Subject to any disclaimer, the term of this patent is extended or adjusted under 35 U.S.C. 154(b) by 466 days.

(21) Appl. No.: 12/756,615

(22) Filed: Apr. 8, 2010

(65) Prior Publication Data

US 2011/0052437 A1 Mar. 3, 2011

(30) Foreign Application Priority Data

Aug. 28, 2009 (JP) ..... 2009-198504

(51) Int. Cl.

| | |
|---|---|
| ***F01C 1/02*** | (2006.01) |
| ***F03C 2/00*** | (2006.01) |
| ***F03C 4/00*** | (2006.01) |
| ***F04C 2/00*** | (2006.01) |

(52) U.S. Cl.
USPC ..... 418/55.1; 418/15; 418/55.5; 418/57; 418/270

(58) Field of Classification Search
USPC ..... 418/15, 55.1–55.6, 57, 270
See application file for complete search history.

(56) References Cited

U.S. PATENT DOCUMENTS

| | | | | |
|---|---|---|---|---|
| 5,674,061 | A * | 10/1997 | Motegi et al. | 418/55.1 |
| 5,855,475 | A * | 1/1999 | Fujio et al. | 418/55.1 |
| 2006/0099098 | A1 * | 5/2006 | Lee et al. | 418/55.1 |

FOREIGN PATENT DOCUMENTS

| | | | |
|---|---|---|---|
| JP | 62-121889 | A | 6/1987 |
| JP | 09-170574 | A | 6/1997 |
| JP | 10-37884 | A | 2/1998 |
| JP | 2008-138644 | A | 6/2008 |
| JP | 2008-157109 | A | 7/2008 |
| JP | 2009-047018 | A | 3/2009 |

* cited by examiner

*Primary Examiner* — Theresa Trieu
(74) *Attorney, Agent, or Firm* — Westerman, Hattori, Daniels & Adrian, LLP

(57) ABSTRACT

There is disclosed a scroll compressor which can lower the noise level of a harsh frequency without taking a lot of troubles. In a sealed container, a scroll compression element and an electromotive element are provided. The scroll compression element is constituted of a fixed scroll including a vertically provided spiral lap, and a swingable scroll including a vertically provided spiral lap and swiveled by a rotary shaft of the electromotive element with respect to the fixed scroll. A refrigerant compressed by gradually reducing, from the outside to the inside, a plurality of compression spaces formed by engaging both the laps with each other is discharged to a discharge pressure space in the sealed container.

6 Claims, 5 Drawing Sheets

SCROLL COMPRESSOR HAVING THROUGH HOLES WITH A SET DEPTH

BACKGROUND OF THE INVENTION

The present invention relates to a scroll compressor comprising a sealed container in which a fixed scroll including a spiral lap, a swingable scroll including a spiral lap and an electromotive element are provided, and configured to discharge, to a discharge pressure space in the sealed container, a refrigerant compressed by gradually reducing, from the outside to the inside, a plurality of compression spaces formed by engaging both the laps with each other.

Heretofore, a usual scroll compressor has been provided with a compression element provided in a sealed container and an electromotive element which drives this scroll compression element. Moreover, the scroll compressor comprises a fixed scroll including a spiral lap vertically provided on the surface of a panel board, and a swingable scroll including a spiral lap vertically provided on the surface of a panel board and swiveled by a rotary shaft of the electromotive element with respect to this fixed scroll. Moreover, the compressor discharges, to a discharge pressure space in the sealed container, a high-temperature high-pressure refrigerant gas compressed by gradually reducing, from the outside to the inside, a plurality of compression spaces formed by engaging both the laps with each other (e.g., see Japanese Patent Application Laid-Open No. 2008-138644 (Patent Document 1)).

On the other hand, an investigation has been performed to lower the noise level of a rotary compressor, thereby decreasing noises having a high sound pressure level and a harsh frequency among pressure pulsation components of the rotary compressor as a noise source. If these frequency components can be decreased by a certain method, another high-frequency noise is left, but the noises can be reduced to such a level as to be less anxious. To solve the problem, a plurality of spaces (side branches) connected to compression chambers in a cylinder are provided in one of upper and lower ends of the cylinder or one of cylinder contact surfaces of upper and lower bearings which hermetically close the upper and lower ends of the cylinder, and pressure pulsation components which especially noticeably influence the noises are damped to lower the noise level in the spaces (e.g., see Japanese Patent Application Laid-Open No. 10-37884 (Patent Document 2)).

Although the noise level is lowered in the scroll compressor in the same manner as in the rotary compressor, the noises are decreased mainly by the improvement of a muffler chamber. Therefore, a problem remains that harsh noises are left without any noticeable improvement.

SUMMARY OF THE INVENTION

The present invention has been developed to solve such a conventional technical problem, and an object thereof is to provide a scroll compressor which can lower a noise level having a harsh frequency without taking a lot of trouble.

To achieve the above object, according to a first aspect of the present invention, there is provided a scroll compressor comprising a sealed container in which a scroll compression element and an electromotive element to drive the scroll compression element are provided, the scroll compression element being constituted of a fixed scroll including a spiral lap vertically provided on the surface of a panel board, and a swingable scroll including a spiral lap vertically provided on the surface of a panel board and swiveled by a rotary shaft of the electromotive element with respect to the fixed scroll, the scroll compressor being configured to discharge, to a discharge pressure space in the sealed container, a refrigerant compressed by gradually reducing, from the outside to the inside, plurality of compression spaces formed by engaging both the laps with each other, the scroll compressor further comprising: through holes formed in the fixed scroll to connect the compression spaces to the discharge pressure space; and normally closed relief valves provided in the fixed scroll on the side of the discharge pressure space to open and close the through holes, the depth dimension of each of the through holes being set to a value corresponding to the wavelength of a noise peak frequency.

Moreover, the scroll compressor of a second aspect of the present invention is characterized in that the above scroll compressor further comprises depressed portions formed in the surface of the fixed scroll on the side of the discharge pressure space, the relief valves are disposed in the depressed portions, and the depth of each of the through holes is set to a value which is substantially ¼ of the wavelength of the noise peak frequency.

Furthermore, the scroll compressor of a third aspect of the present invention is characterized in that in the second aspect of the present invention, the through holes are formed at two positions which are point-symmetric with respect to the center of the fixed scroll, and the depressed portions formed so as to correspond to the through holes, respectively, extend in a direction crossing, at right angles, the center line of the fixed scroll passing the centers of the through holes, respectively.

In addition, the scroll compressor of a fourth aspect of the present invention is characterized in that in the above second aspect of the present invention, each of the relief valves is constituted of a valve attached to the inside of the depressed portion, and a spring which constantly urges the valve in such a direction as to close the through hole.

Furthermore, the scroll compressor of a fifth aspect of the present invention is characterized in that in any one of the first to fourth aspects of the present invention, the relief valves open the through holes during the excessive compression of the scroll compression element.

In addition, the scroll compressor of a sixth aspect of the present invention is characterized in that in any one of the first to fourth aspects of the present invention, the relief valves open the through holes during the liquid compression of the scroll compression element.

In the first aspect of the present invention, in the sealed container, the scroll compression element and the electromotive element to drive the scroll compression element are provided. Moreover, the scroll compression element is constituted of the fixed scroll including the spiral lap vertically provided on the surface of the panel board, and the swingable scroll including a spiral lap vertically provided on the surface of a panel board and swiveled by the rotary shaft of the electromotive element with respect to the fixed scroll. The scroll compressor discharges, to the discharge pressure space in the sealed container, the refrigerant compressed by gradually reducing, from the outside to the inside, the plurality of compression spaces formed by engaging both the laps with each other. The scroll compressor further comprises the through holes formed in the fixed scroll to connect the compression spaces to the discharge pressure space; and the normally closed relief valves provided in the fixed scroll on the side of the discharge pressure space to open and close the through holes. The depth dimension of each of the through holes is set to the value corresponding to the wavelength of the noise peak frequency. Therefore, in a case where the scroll compressor further comprises the depressed portions formed in the surface of the fixed scroll on the side of the discharge pressure space, the relief valves are disposed in the depressed portions and the depth of each of the through holes is set to the value which is substantially ¼ of the wavelength of the noise peak frequency as in the second aspect of the present invention, noises generated in the vicinity of a discharge hole can be taken into the through holes and decreased. That is, the through holes of the relief valves are formed into such a depth that when noises go into and out of the through holes, the crest and trough of the same noise wavelength cancel out each other. In consequence, when the relief valves are not opened owing to the abnormal rise of a pressure in compression chambers, the noise level can be canceled and lowered within the through holes of the relief valves. Therefore, the thickness of the whole panel board of the fixed scroll does not have to be decreased, whereby the noise level can be lowered while improving the reliability of the scroll compressor in a state where the strength of the fixed scroll is kept. In particular, since the through holes of the relief valves are utilized to lower the noise level, any special hole for lowering the noise level does not have to be provided. Therefore, the reliability of the scroll compressor and the lowering of the noise level can be achieved at a minimum cost.

Moreover, according to the third aspect of the present invention, in the second aspect of the present invention, the through holes are formed at two positions which are point-symmetric with respect to the center of the fixed scroll, and the depressed portions formed so as to correspond to the through holes, respectively, extend in a direction crossing, at right angles, the center line of the fixed scroll passing the centers of the through holes, respectively. Therefore, for example, when both the depressed portions are extended along the extension of the center line passing the two through holes, the fixed scroll has a weakened strength at both the extending depressed portions and easily bends at the portions, but in the present invention, the fixed scroll can be prevented from being easily bent. In consequence, the lowering of the strength of the fixed scroll can be minimized.

Furthermore, according to the fourth aspect of the present invention, in the second aspect of the present invention, each of the relief valves is constituted of the valve attached to the inside of the depressed portion, and the spring which constantly urges the valve in such a direction as to close the through hole. Therefore, the depth dimensions of the through holes from the valves to the compression spaces can easily be regulated to a value corresponding to the wavelength of the noise peak frequency. In this case, the depth dimensions of the through holes from the valves to the compression spaces are simply varied, whereby the depths of the through holes can be set to such a value that when the noises go into or out of the through holes, the crest waveform of the same noise wavelength can cancel a trough waveform thereof or the trough waveform can cancel the crest waveform. Moreover, when the valves are not opened owing to the abnormal rise of the pressure in the compression chambers, the noise level can be lowered in the through holes from the valves to the compression spaces. In consequence, the depth dimensions of the through holes from the valves to the compression spaces can simply be regulated to lower the noise level, whereby suitable processability can be obtained without taking a lot of troubles. Therefore, the noise level can noticeably be lowered while keeping the strength of the fixed scroll.

Furthermore, according to the fifth aspect of the present invention, in any one of the first to fourth aspects of the present invention, the relief valves open the through holes during the excessive compression of the scroll compression element. Therefore, it is possible to prevent a disadvantage that when the pressure in the compression chambers abnormally rises, the reliability is lowered owing to the increase of inputs or the increase of burdens on slidable portions. Moreover, when the relief valves are not opened owing to the abnormal rise of the pressure in the compression chambers, the noise level can be lowered in the through holes. Therefore, the protection of the scroll compressor and the lowering of the noise level can be achieved at a minimum cost.

In addition, according to the sixth aspect of the present invention, in any one of the first to fourth aspects of the present invention, the relief valves open the through holes during the liquid compression of the scroll compression element. In consequence, when a liquid refrigerant flows into the compression chambers, the relief valves open to discharge the liquid refrigerant from the compression chambers to prevent the disadvantage that the reliability is lowered owing to the increase of the inputs or the increase of the burdens on the slidable portions. Moreover, when the relief valves are not opened owing to the abnormal rise of the pressure in the compression chambers, the noise level can be lowered in the through holes. Therefore, the protection of the scroll compressor and the lowering of the noise level can be achieved at a minimum cost.

DETAILED DESCRIPTION OF THE PREFERRED EMBODIMENTS

The present invention is characterized mainly in that a noise level having a harsh frequency generated during the operation of a scroll compressor is lowered without taking a lot of troubles. A purpose of lowering the harsh noise level is realized by a simple structure in which a depth dimension of each of through holes formed in a fixed scroll to connect compression spaces to a discharge pressure space is only set to a value corresponding to the wavelength of a noise peak frequency.

Embodiment 1

Figure 1:
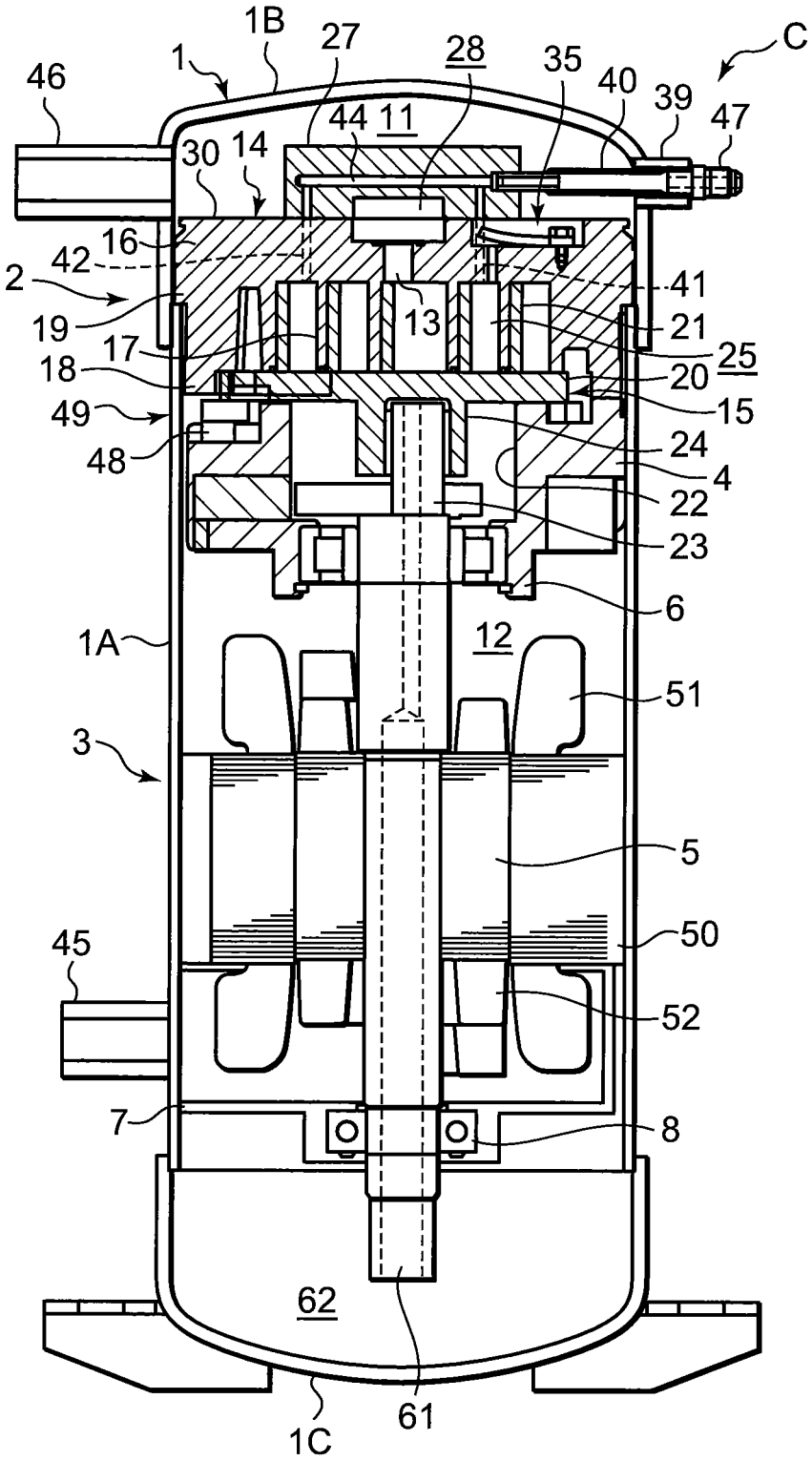
FIG. 1 is a vertical sectional view of a scroll compressor showing one embodiment of the present invention (Embodiment 1)
Figure 2:
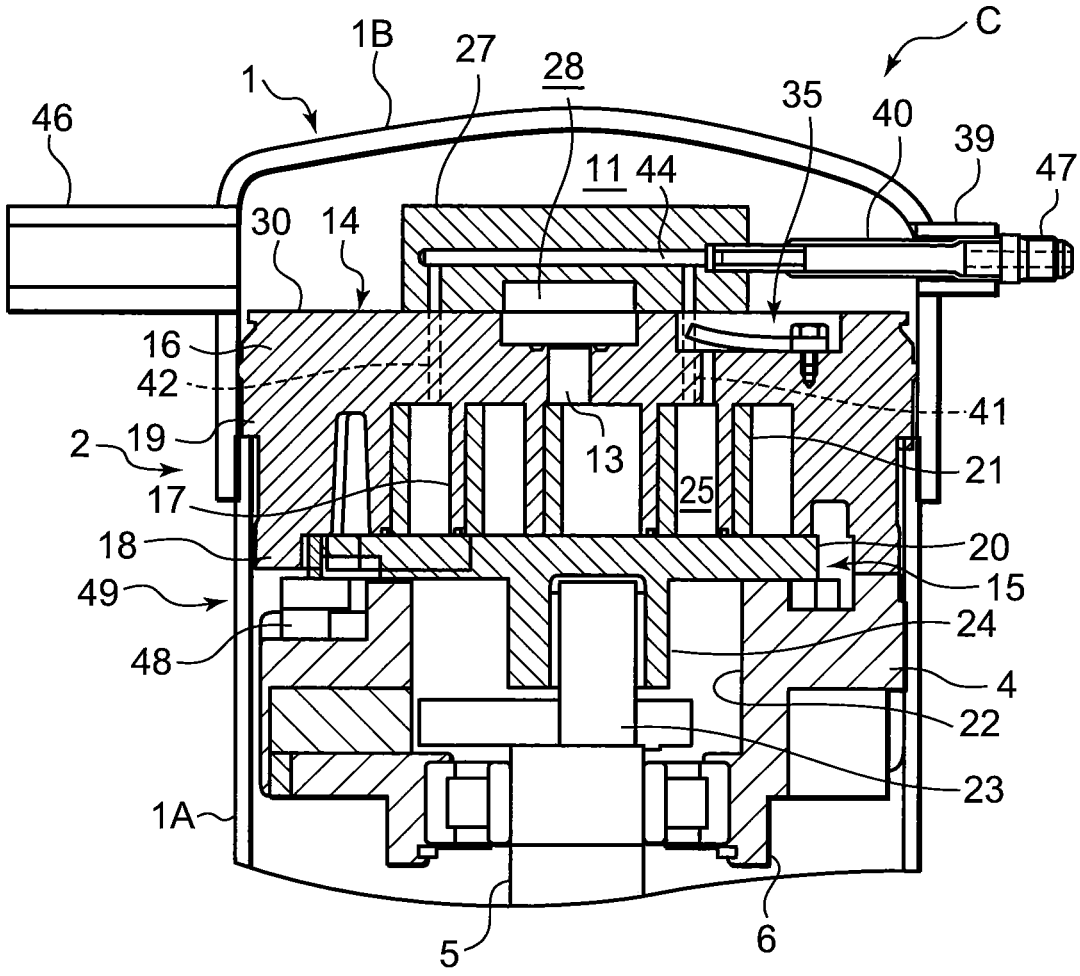
FIG. 2 is an enlarged view of a main part of the scroll compressor of FIG. 1.

Hereinafter, an embodiment of the present invention will be described in detail. FIG. 1 shows a vertical sectional view of a scroll compressor C showing one embodiment of the present invention, and FIG. 2 shows an enlarged view of a main part of the scroll compressor C of FIG. 1, respectively.

In FIG. 1, the scroll compressor C is of an internal low pressure type, and comprises a vertically cylindrical sealed container 1 made of a steel plate. The sealed container 1 is constituted of a container main body 1A having a vertically long cylindrical shape, an end cap 1B (on the upside in the drawing) welded and fixed to each end (both upper and lower ends) of the container main body 1A and having a substantially bowl-like shape and a bottom cap 1C (on the downside in the drawing). Hereinafter, the scroll compressor C will be described while an end cap 1B side of the sealed container 1 is referred to as the upside and a bottom cap 1C side thereof is referred to as the downside.

In the sealed container 1, an electromotive element 3 is received as driving means on the downside, and a scroll compression element 2 driven by a rotary shaft 5 of the electromotive element 3 is received on the upside. Between the scroll compression element 2 and the electromotive element 3 in the sealed container 1, an upper support frame 4 (a main frame) is received, and the upper support frame 4 is provided with a bearing portion 6 and a boss storage portion 22 in the center thereof. The bearing portion 6 supports the tip (the upper end) of the rotary shaft 5, and is formed so as to project downwardly from the center of one surface (the lower surface) of the upper support frame 4. Moreover, the boss storage portion 22 receives a boss 24 of a swingable scroll 15 described later, and is formed by downwardly depressing the center of the other surface (the upper surface) of the upper support frame 4.

Moreover, in the sealed container 1 under the electromotive element 3, a lower support frame 7 (a bearing plate) is received, and the center of the lower support frame 7 is provided with a bearing 8. The bearing 8 supports the tail end (the lower end) of the rotary shaft 5, and is formed so as to project downwardly from the center of one surface (the lower surface) of the lower support frame 7. Moreover, a space under the lower support frame 7, that is, a bottom part in the sealed container 1 is an oil reservoir 62 in which a lubricant for lubricating the scroll compression element 2 and the like is stored.

The tip (the upper end) of the rotary shaft 5 is provided with an eccentric shaft 23. The center of the eccentric shaft 23 is provided eccentrically from the axial center of the rotary shaft 5, and the eccentric shaft is inserted into the boss 24 of the swingable scroll 15 via a slide bush and a swivel bearing (not shown) so that the swingable scroll 15 can be driven and swiveled.

The scroll compression element 2 is constituted of a fixed scroll 14 and the swingable scroll 15. The fixed scroll 14 is integrally constituted of a round panel board 16; a spiral lap 17 vertically provided on one surface (the lower surface) of the panel board 16 and having an involute shape or a curved shape approximate to this involute shape; a peripheral wall 18 vertically provided so as to surround the periphery of the lap 17; and a flange 19 provided so as to project from the periphery of the peripheral wall 18 (the side of the other surface (the upside) of the peripheral wall 18) and having an outer peripheral edge shrink-fitted into the inner surface of the container main body 1A of the sealed container 1. Moreover, in the fixed scroll 14, the flange 19 is shrink-fitted and fixed to the inner surface of the container main body 1A, and the center of the panel board 16 (the center of the fixed scroll 14) is provided with a discharge hole 13 through which a refrigerant gas compressed by the scroll compression element 2 is discharged to a discharge pressure space 11 (a muffler chamber) formed on the upside in the sealed container 1. In the fixed scroll 14, the projecting direction of the lap 17 is a downward direction.

The electromotive element 3 is constituted of a stator 50 fixed to the sealed container 1 and a rotor 52 disposed on the inner side of the stator 50 to rotate in the stator 50, and the rotary shaft 5 is fitted into the center of the rotor 52. The stator 50 is a laminate in which a plurality of electromagnetic steel plates are laminated, and has a stator coil 51 wound around tooth portions of the laminate. Moreover, the rotor 52 is also a laminate of electromagnetic steel plates in the same manner as in the stator 50.

Moreover, in the rotary shaft 5, an oil path (not shown) is formed along the axial direction of the rotary shaft 5, and this oil path comprises a suction port 61 positioned at the lower end of the rotary shaft 5. The suction port 61 is immersed into the lubricant stored in the oil reservoir 62, and is opened in the lubricant. Moreover, the oil path is provided with an oil supply port for supplying the lubricant at a position corresponding to each bearing. According to such a constitution, when the rotary shaft 5 rotates, the lubricant stored in the oil reservoir 62 enters the oil path through the suction port 61 of the rotary shaft 5, and is pumped upwardly. Moreover, the pumped lubricant is supplied to the bearings and slidable portions of the scroll compression element 2 through the oil supply ports or the like.

The sealed container 1 is provided with a refrigerant introduction tube 45 for introducing a refrigerant into a space 12 on the downside in the sealed container 1, and a refrigerant discharge tube 46 for discharging, to the outside, the refrigerant compressed by the scroll compression element 2 and discharged from the discharge hole 13 to the discharge pressure space 11 on the upside in the sealed container 1 through a discharge muffler chamber 28 described later. It is to be noted that in the present embodiment, the refrigerant introduction tube 45 is welded and fixed to the side surface of the container main body 1A of the sealed container 1, and the refrigerant discharge tube 46 is welded and fixed to the side surface of the end cap 1B.

Figure 3:
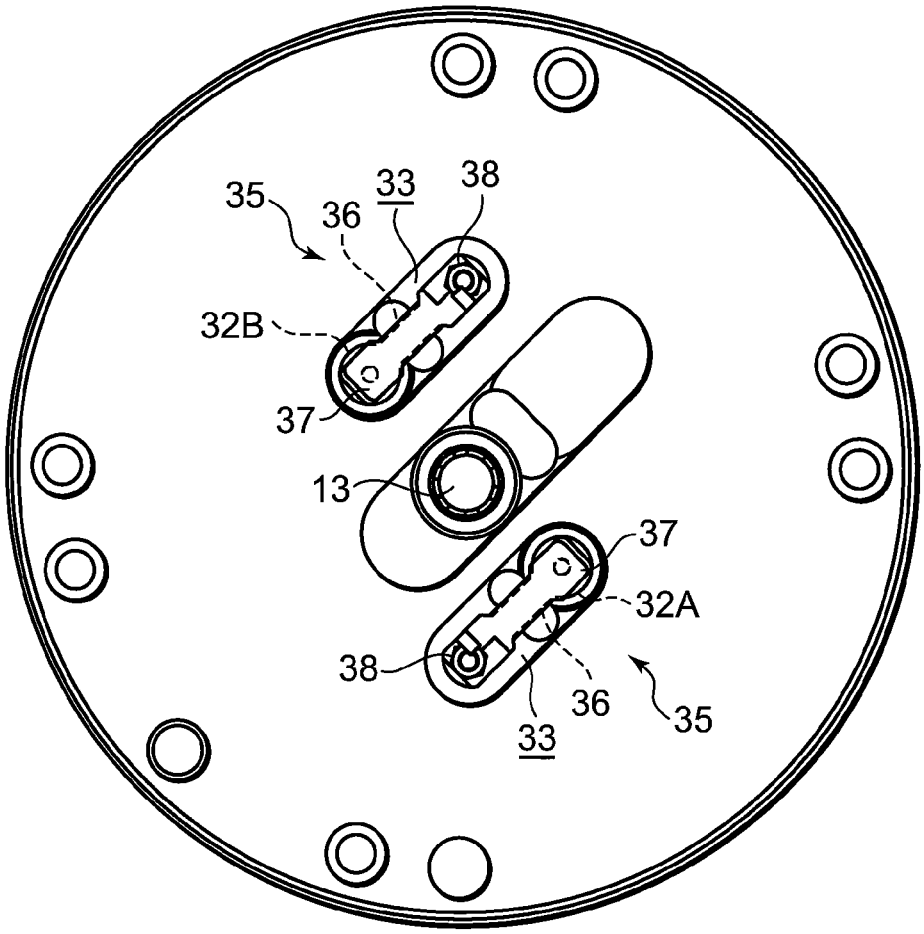
FIG. 3 is a plan view of a fixed scroll (excessive compression) constituting the scroll compressor of the embodiment of the present invention and comprising springs which are, leaf springs.

On the other hand, in the constitution of the present embodiment, an upper surface 30 of the panel board 16 of the fixed scroll 14 (the surface opposite to the lap 17) is disposed so as to face the discharge pressure space 11 formed on the upside in the sealed container 1. The upper surface 30 of the panel board 16 of the fixed scroll 14 is provided with a discharge valve (not shown) connected to the discharge hole 13 and a plurality of (two in the embodiment) relief valves 35 adjacent to this discharge valve (two relief valves 35 are shown in FIG. 3). The relief valves 35 prevent the excessive compression of the refrigerant, and the discharge pressure space 11 on the upside in the sealed container 1 is connected to a compression space 25 via the relief valves 35 and through holes 32 (shown in FIG. 4) formed so as to extend through the panel board 16 of the fixed scroll 14. It is to be. noted that the through holes 32 and the relief valves 35 will be described later in detail.

In the discharge pressure space 11 on the upside in the sealed container 1, a cover 27 fixed to the fixed scroll 14 via screws is provided. The center of the lower surface of the cover 27 is provided with the discharge muffler chamber 28 which is depressed from the fixed scroll 14 side to the discharge pressure space 11 side and which forms a muffler chamber together with the discharge pressure space 11. The discharge muffler chamber 28 is connected to the discharge hole 13, and is also connected to the inside of the discharge pressure space 11 on the upside in the sealed container 1 via a gap (not shown) provided between the cover 27 and the fixed scroll 14.

The swingable scroll 15 is a scroll which swivels with respect to the fixed scroll 14 shrink-fitted and fixed to the inner surface of the container main body 1A as described above, and is constituted of a disc-like panel board 20; a spiral lap 21 vertically provided on one surface (the upper surface) of the panel board 20 and having an involute shape or a curved shape approximate to this involute shape; and the boss 24 formed so as to project from the center of the other surface (the lower surface) of the panel board 20. Moreover, in the swingable scroll 15, the projecting direction of the lap 21 is an upward direction, and the lap 21 is rotated as much as 180 degrees and disposed so as to face and engage with the lap 17 of the fixed scroll 14, thereby forming the compression space 25 (a plurality of compression chambers) between the internal laps 17 and 21.

That is, the lap 21 of the swingable scroll 15 faces the lap 17 of the fixed scroll 14, and the laps engage with each other so that the tip surfaces of both the laps 21, 17 come in contact with facing bottom surfaces (the panel board 16 surface and the panel board 20 surface). Moreover, the swingable scroll 15 is fitted into the eccentric shaft 23 provided eccentrically from the axial center of the rotary shaft 5. Therefore, in the compression space 25, the two spiral laps 21, 17 are eccentric from each other, and come in contact with each other along a line in an eccentric direction to form a plurality of confined spaces, whereby the spaces are the compression chambers.

In the fixed scroll 14, the flange 19 provided around the periphery of the peripheral wall 18 is fixed to the upper support frame 4 via a plurality of bolts (not shown). Moreover, the swingable scroll 15 is supported by the upper support frame 4 via Oldham mechanism 49 constituted of Oldham ring 48 and Oldham key. In consequence, the swingable scroll 15 does not rotate on its axis but performs a swivel motion with respect to the fixed scroll 14.

The swingable scroll 15 eccentrically revolves around the fixed scroll 14, and hence the eccentric direction and contact position of the two spiral laps 17, 21 move while the laps rotate, whereby the compression chambers inwardly shift to the compression space 25 from the outside and are gradually reduced. First, the low pressure refrigerant gas, which has entered the outer compression space 25 and is confined therein, gradually moves inwardly while being compressed in an insulating manner, thereby obtaining an intermediate pressure. When the gas finally reaches the center, the gas becomes a high-temperature high-pressure refrigerant gas. This refrigerant gas is forwarded to the discharge pressure space 11 through the discharge hole 13 and the discharge muffler chamber 28 provided in the center.

In the panel board 16 of the fixed scroll 14, injection holes 41, 42 are formed so as to extend through the panel board, and cool the refrigerant gas so that the refrigerant gas compressed in the compression space 25 to obtain a high pressure is prevented from reaching an excessively high temperature. Both the injection holes 41, 42 on the downside (the swingable scroll 15 side) open on the laps 17, 21 side, and are connected to the compression space 25 having the intermediate pressure. The one injection hole 41 is formed at a position shifted as much as 180 degrees from the other injection hole 42 with respect. to the center of the fixed scroll 14, and the injection holes are formed on the inner and outer sides of the lap 17 vertically provided in the fixed scroll 14, respectively.

Moreover, in the cover 27 (in a thick plate), a liquid injection passage 44 is formed through which the liquid refrigerant in a liquid receiving unit (not shown) is discharged from both the injection holes 41, 42 to the compression space 25 via a refrigerant circuit (shown in FIGS. 1 and 2). The liquid injection passage 44 is connected to both the injection holes 41, 42 formed in the panel board 16 of the fixed scroll 14, and both the injection holes 41, 42 are opened in the compression space 25 (opened in the surface of the panel board 16 (the surface on the lap 17 side).

The liquid injection passage 44 is connected to a pipe 40. The pipe 40 is a hollow tube, and has one end thereof pressed into the liquid injection passage 44 of the cover 27 and the other end thereof welded and fixed to the end cap 1B via a sleeve 39. That is, the pipe 40 is attached so as to bridge a gap between the end cap 1B and the cover 27, and a connection tube 47 connected to the pipe 40 is connected to a pipe (not shown) for the injection of the liquid from the liquid receiving unit, thereby forming a liquid injection circuit.

On the other hand, the through holes 32 are formed at two point-symmetric positions (through holes 32A, 32B) with respect to the center of the fixed scroll 14 (the center of the discharge hole 13 (FIG. 3). The through holes 32 are provided at the positions of the compression space 25 having the intermediate pressure, and formed so as to have a diameter which is from about 50% to 80% of the thickness dimension of the lap 21 of the swingable scroll 15. Moreover, the one through hole 32A opens between the lap 21 vertically provided in the swingable scroll 15 and the lap 17 vertically provided in the fixed scroll 14 positioned on the inner side of lap of the swingable scroll, and the other through hole 32B opens between the lap 21 vertically provided in the swingable scroll 15 and the lap 17 vertically provided in the fixed scroll 14 positioned on the outer side of the lap of the swingable scroll. In this case, the compression space 25 is divided into three stages of a low pressure portion, an intermediate pressure portion and a high pressure portion.

That is, the one through hole 32A is positioned on the high pressure chamber side of the intermediate pressure chamber of the compression space 25, and is formed at such a position as to be closed with the lap 21 vertically provided in the swingable scroll 15 when the high pressure gas starts to be discharged from the discharge hole 13. Moreover, the other through hole 32B is also positioned on the high pressure chamber side of the intermediate pressure chamber of the compression space 25, and is formed at such a position as to be closed with the lap 21 vertically provided in the swingable scroll 15 when the high pressure gas starts to be discharged from the discharge hole 13.

Moreover, vertically long .depressed portions 33 (shown in FIGS. 3 and 4) corresponding to the through holes 32A, 32B are formed, and both the depressed portions 33 extend in a direction crossing, at right angles, the center line of the fixed scroll 14 passing the center of each through hole 32, respectively. In consequence, both the depressed portions 33 dug into a vertically long shape are not disposed along one straight line in a longitudinal direction, whereby the lowering of the strength of the fixed scroll 14 along the longitudinal direction of both the depressed portions 33 can be minimized. It is to be noted that the depths of both the through holes 32 may be an equal dimension or depth dimensions corresponding to different noise wavelengths. Moreover, the depth dimensions of the depressed portions 33 will be described later in detail.

Furthermore, as shown in FIG. 3, each relief valve 35 is constituted of a spring 36 which is a vertically long leaf spring provided on the upper surface 30 of the panel board 16 of the fixed scroll 14, and a vertically long backer valve 37 which is slightly larger than the spring 36 and is not deformed, thereby preventing the wear-out and deterioration of the spring 36.

The relief valve 35 is usually a so-called lead valve. Moreover, the relief valve 35 is fixed to the panel board 16 via a bolt 38 in a state where the spring 36 is sandwiched between the panel board 16 and the backer valve 37. The relief valve 35 corresponding to the through hole 32 of the fixed scroll 14 is fixed via the bolt 38, and the spring 36 constantly closes the through hole 32 by its elastic force and the pressure of the high pressure gas which is exerted as a back pressure. It is to be noted that the backer valve 37 warps as much as a predetermined distance away from the through hole 32, as the valve extends from a bolt 38 fixing side to a through hole 32 side.

Moreover, when the pressure of the compression space 25 rises above a predetermined pressure, the spring 36 of the relief valve 35 is elastically deformed upwardly (a backer valve 37 direction) with the rise of the pressure, thereby opening the through hole 32. Specifically, when the pressure of the refrigerant which is being compressed in the compression space 25 reaches a preset discharge pressure, the relief valve 35 is opened to discharge the refrigerant in the compression space 25 to the discharge pressure space 11 on the upside in the sealed container 1 through the through hole 32. This prevents the abnormal pressure rise in the compression space 25 and the increase of the inputs of the scroll compressor C (power losses).

Additionally, in the scroll compressor C, noises having a harsh frequency around 2200 Hz have been generated especially in the vicinity of the discharge hole 13 of the refrigerant gas during an operation as described in a conventional example. Next, a method for inexpensively lowering the harsh noise level without taking a lot of troubles will be described. The scroll compressor C is provided with various protection valves in the middle of a compression process so as to prevent the damage of the compressor due to excessive compression, liquid compression or the like. According to the present invention, the harsh noise level is lowered by the through holes 32 of the protection valves (the relief valves 35 in the present invention).

Figure 4:
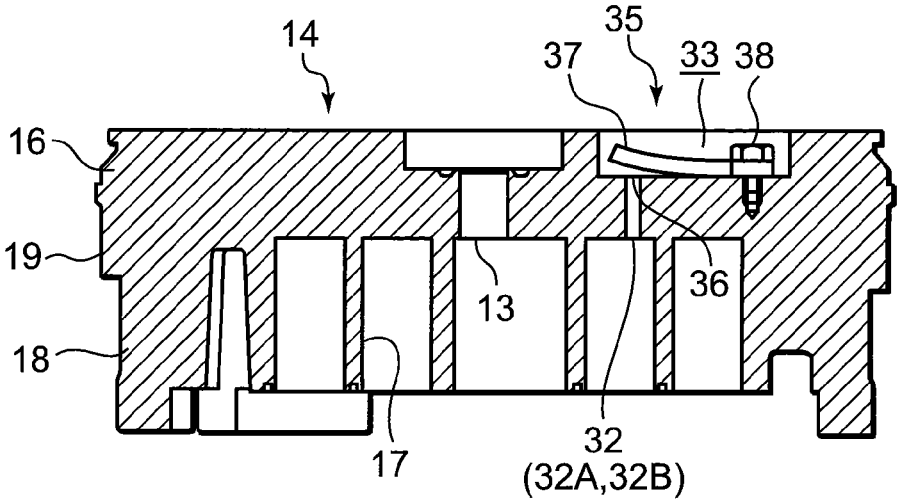
FIG. 4 is a vertical sectional side view of the fixed scroll constituting the scroll compressor of FIG. 2.

In this case, as shown in FIGS. 3 and 4, the depressed portions 33 are formed in the surface of the fixed scroll 14 on the side of the discharge pressure space 11, and the relief valves 35 are disposed in the depressed portions 33. The depressed portions 33 are formed into such a vertically long shape that the vertically long springs 36 and backer valves 37 constituting the relief valves 35 can easily be received. Moreover, the surface of the fixed scroll 14 on the discharge pressure space 11 side is dug in the vertically long shape as it is in a lap 17 direction to form the depressed portions 33, whereby the depth dimension of each through hole 32 is set to a value corresponding to the wavelength of the noise peak frequency. Each depressed portion 33 is formed so that the depth dimension of the through hole 32 is a depth dimension corresponding to a wavelength which is ¼ of the wavelength of the harsh noise peak frequency.

In this case, the depth dimension of each through hole 32 is set so that when the wavelength of a specific harsh frequency enters the through hole 32 and is reflected by the bottom surface of the through hole 32 to exit from the through hole, the frequency can be offset by the next frequency of the same wavelength entering the through hole 32 to cancel out the noise. Specifically, as to the wavelength, for example, a plus wavelength and a minus wavelength constitute one wavelength (one cycle frequency), and one wavelength is constituted of a plus ½ wavelength and a minus ½ wavelength.

In this case, when the plus wavelength of one frequency enters the through hole 32 and is reflected by the spring 36 provided on the bottom surface of the through hole 32 to exit from the through hole 32 and the minus wavelength enters the through hole 32, the plus wavelength collides with the minus wavelength (the crest and trough of the wavelength) to form a zero wavelength, whereby one frequency is offset to form the zero wavelength. That is, when the whole plus ½ wavelength enters the through hole 32 and is reflected by the spring 36 to exit from the through hole, the wavelength is caused to collide with the minus ½ wavelength, whereby the plus wavelength and the minus wavelength are offset to form the zero wavelength. In consequence, the depth of the through hole 32 may be such a depth that the plus ½ wavelength enters the through hole 32 and is reflected by the spring 36 to exit from the through hole. Consequently, the depth of the through hole 32 is a depth of the ½ wavelength of the whole plus ½ wavelength. That is, when the depth of the through hole 32 is the depth of ¼ of the noise wavelength, the noise wavelength is canceled in the through hole 32, whereby the noise level can be lowered.

Figure 5:
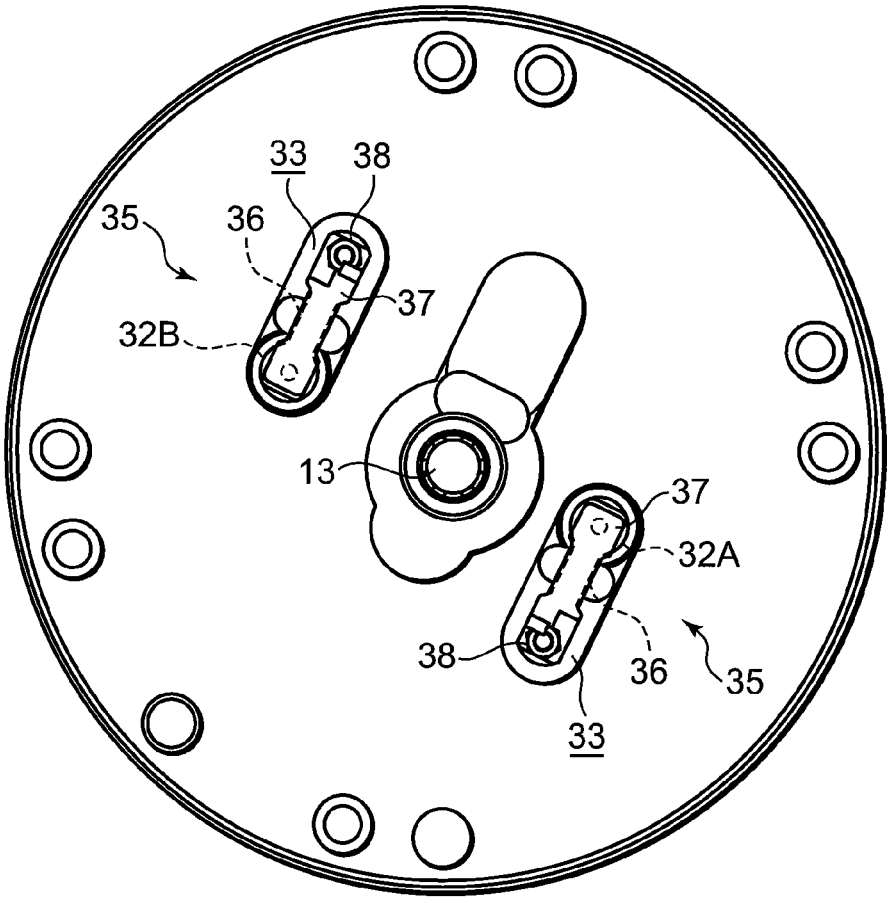
FIG. 5 is a plan view of the fixed scroll (liquid compression) constituting the scroll compressor showing the embodiment of the present invention and comprising the springs which are the leaf springs.
Figure 6:
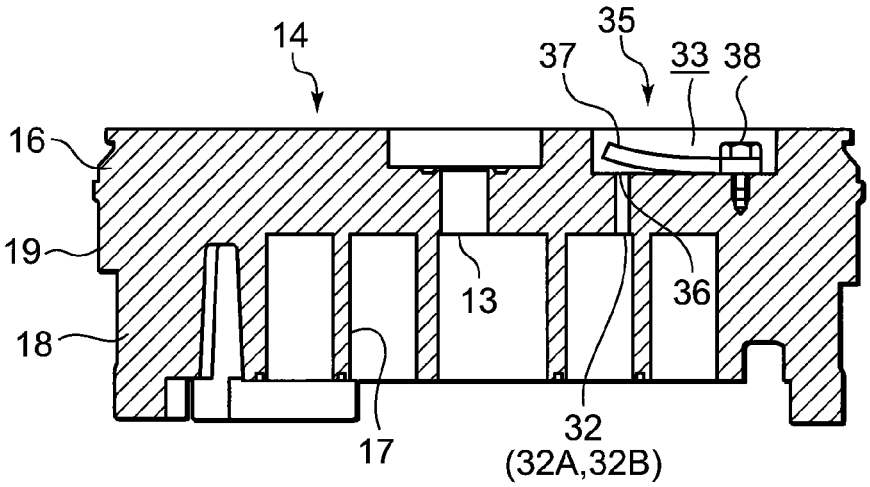
FIG. 6 is a vertical sectional side view of the fixed scroll constituting the scroll compressor of FIG. 2.

Next, FIGS. 5 and 6 show a fixed scroll 14 comprising protection valves (relief valves 35) for preventing the liquid compression of a scroll compressor C. The fixed scroll 14 of the scroll compressor C has substantially the same constitution as that of the above embodiment. Hereinafter, a different part will be described. It is to be noted that the same part as that of the above embodiment is denoted with the same reference numerals, and the description thereof is omitted.

In a compression space 25, a low pressure refrigerant, which has entered the outer compression space 25 and is confined therein as described above, does not always have a gas state, is often sucked in a liquid state (a liquid refrigerant state), and keeps a compressed state as it is sometimes. Moreover, a lubricant supplied to bearings and slidable portions of a scroll compression element 2 is mixed with the liquid refrigerant, and the refrigerant is confined in the compression space 25 and keeps its compressed state as it is sometimes. When the compressing operation of the liquid refrigerant confined in the compression space 25 starts, the liquid refrigerant of the compression space 25 has a liquid ring state, whereby an excessively large impulse force is exerted to mechanical components, and this causes a damage to the scroll compressor C.

To solve the problem, through holes 32 are provided at positions before the liquid compression is started to damage the scroll compressor C, and when the pressure of the compression space abnormally rises owing to the liquid refrigerant, relief valves 35 open to discharge a high pressure refrigerant gas from the through holes 32 to a discharge pressure space 11. That is, a space between both the through holes 32A and 32B of the relief valves 35 provided in the fixed scroll 14 is larger than that between both the through holes 32A and 32B of FIG. 3. In this case, both the through holes 32A and 32B are positioned substantially at the head of an intermediate pressure range. In consequence, when the pressure of the compression space abnormally rises, the relief valves 35 open to discharge the liquid refrigerant form the through holes 32 to the discharge pressure space 11, whereby the damage to the scroll compressor C is prevented.

Moreover, vertically long depressed portions 33 formed so as to correspond to the through holes 32 as described above extend in a direction crossing, at right angles, the center line of the fixed scroll 14 passing the centers of the through holes 32, respectively. In consequence, both the depressed portions 33 dug in a vertically long shape are not disposed along one straight line in a longitudinal direction, and hence the lowering of the strength of the fixed scroll 14 along the longitudinal direction of both the depressed portions 33 can be minimized.

In this way, the scroll compressor comprises the through holes 32 formed in the fixed scroll 14 to connect the compression space 25 to the discharge pressure space 11 and the normally closed relief valves 35 provided in the fixed scroll 14 on the side of the discharge pressure space 11 to open and close the through holes 32, and the depth dimension of each of the through holes 32 is set to a value corresponding to the wavelength of a noise peak frequency. Therefore, when the scroll compressor comprises the depressed portions 33 formed in the surface of the fixed scroll 14 on the discharge pressure space 11 side, the relief valves 35 are disposed in the depressed portions 33 and the depth of each through hole 32 is substantially set to a value of ¼ of the wavelength of the noise peak frequency, harsh noises generated in the vicinity of a discharge hole 13 can be taken into the through holes 32 and can securely be decreased.

That is, the through holes 32 of the relief valves 35 are formed in such a depth that when the noises go into and out of the through holes 32, the crest and trough of the same noise wavelength cancel out each other. In consequence, when the relief valves 35 are not opened owing to the abnormal rise of the pressure of the compression space 25 (when the relief valves 35 are closed), the noises can be canceled in the through holes 32 of the relief valves 35 and decreased. Therefore, the thickness of the whole panel board 16 of the fixed scroll 14 does not have to be decreased, but the noises can be decreased while improving the reliability of the scroll compressor C in a state where the strength of the fixed scroll 14 is kept. It is to be noted that, needless to say, when the pressure in the compression space 25 abnormally rises, the relief valves 35 open to discharge the liquid refrigerant (or an excessively compressed gas) in the compression space 25 to the discharge pressure space 11 side, whereby the scroll compressor C is protected.

Moreover, the through holes 32 are formed at two point-symmetric positions with respect to the center of the fixed scroll 14, and the depressed portions 33 formed so as to correspond to the through holes 32, respectively, extend in the direction crossing, at right angles, the center line of the fixed scroll 14 passing the centers of the through holes 32, respectively. Therefore, the ease of the bending of the fixed scroll 14 can be avoided, as compared with a case where both the depressed portions 33 are extended along the extension of the center line passing the two through holes 32 and the fixed scroll 14 has a weakened strength at both the extending depressed portions 33 and easily bends at the portions. In consequence, the lowering of the strength of the fixed scroll 14 can be minimized.

Moreover, in the relief valves 35, the through holes 32 open during the liquid compression of the scroll compression element 2, whereby the breakdown of the scroll compressor C during the abnormal rise of the pressure in the compression space 25 is prevented. Moreover, when the relief valves 35 are not opened owing to the abnormal rise of the pressure in the compression space 25, the noises can be decreased in the through holes 32. In consequence, the protection of the scroll compressor C and the decrease of the noises can be achieved at a minimum cost.

Embodiment 2

Figure 7:
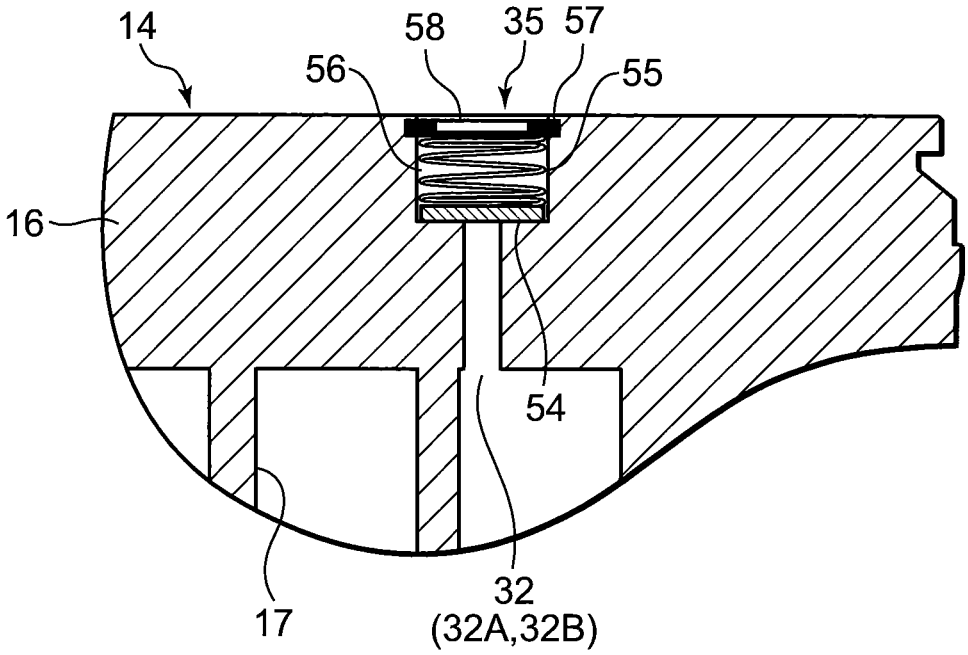
FIG. 7 is a vertical sectional view (when a relief valve is closed) of a fixed scroll constituting a scroll compressor showing an embodiment of the present invention and comprising a coil spring (Embodiment 2)
Figure 8:
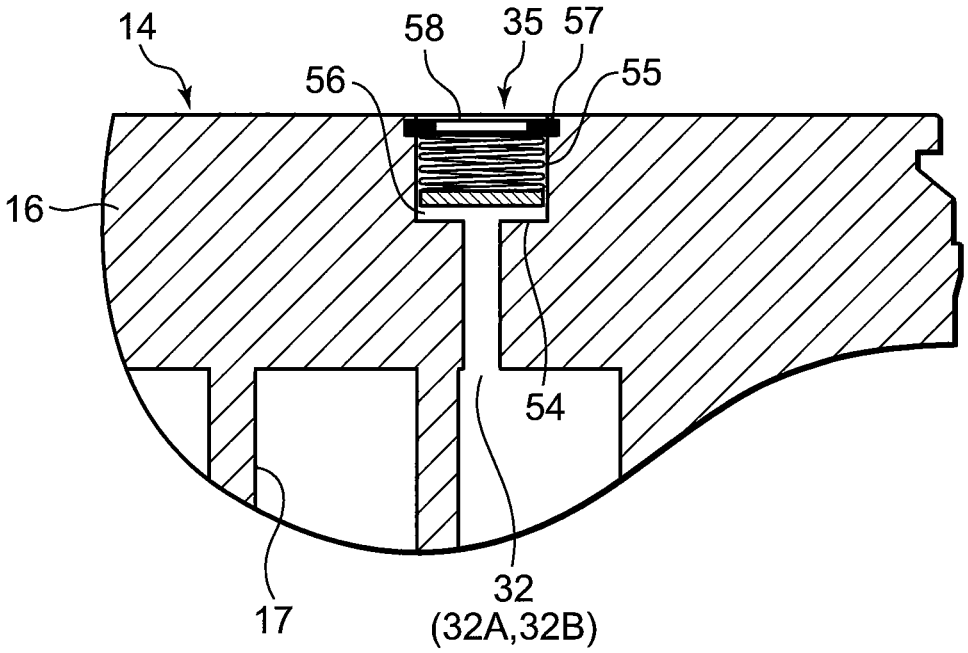
FIG. 8 is a vertical sectional view (when the relief valve is opened) of the fixed scroll constituting the scroll compressor of FIG. 7 and comprising the coil spring.

Next, FIGS. 7 and 8 show a fixed scroll 14 comprising protection valves (relief valves 35) for preventing the excessive compression of a scroll compressor C of the present invention. The fixed scroll 14 of the scroll compressor C has substantially the same constitution as that of the above embodiment. Hereinafter, a different part will be described. It is to be noted that the same part as that of the above embodiment is denoted with the same reference numerals, and the description thereof is omitted.

Each of the relief valves 35 is constituted of a valve plate 54 (corresponding to a valve of the present invention) attached to the inside of a depressed portion 56 dug in a round shape, and a coil spring 55 (corresponding to a spring of the present invention) which constantly urges the valve plate 54 in such a direction as to close a through hole 32. The diameter of the depressed portion 56 is larger than that of the through hole 32, and in the inner periphery of the depressed portion 56, the depressed portion 56 is projected to provide a groove 57 in the vicinity of an upper surface 30 of a panel board 16 of the fixed scroll 14.

A C-ring 58 is fitted into the groove 57 to prevent the coil spring 55 from being detached from the depressed portion 56, and the coil spring 55 constantly urges the valve plate 54 in such a direction as to close the through hole 32. It is to be noted that the depressed portion 56 and the through hole 32 are disposed along the same axial center, and the through holes 32 are formed at two point-symmetric positions with respect to the center of the fixed scroll 14 in the same manner as in Embodiment 1.

The depth dimension of each through hole 32 is set to a value corresponding to the wavelength of a noise peak frequency as described above, by regulating the depth dimension of the depressed portion 56. Moreover, as to the relief valve 35 shown in FIG. 8, during the excessive compression of a scroll compression element 2, the valve plate 54 is pushed upwardly by the pressure, and the coil spring 55 is compressed to open the relief valve 35, thereby discharging a high pressure gas to a discharge pressure space 11 side.

In consequence, it is possible to prevent a disadvantage that reliability is lowered owing to the increase of inputs and the increase of burdens on slidable portions during the abnormal rise of the pressure in a compression space 25. Moreover, when the relief valves 35 are not opened owing to the abnormal rise of the pressure in the compression space 25 (when the relief valves 35 are closed), the noises can be decreased in the through holes 32. In consequence, the protection of the scroll compressor C and the decrease of the noises can be achieved at a minimum cost. It is to be noted that in a case where the liquid compression of the scroll compression element 2 is prevented, when through holes 32A, 32B are positioned substantially at the head of an. intermediate pressure range in the same manner as in the liquid compression of the above embodiment, a similar effect can be obtained.

In this way, in the relief valves 35, the depth dimension of each depressed portion 56 is simply regulated, whereby the depth dimension of the through hole 32 from the valve plate 54 to the compression space 25 can easily be regulated to a value corresponding to the wavelength of a noise peak frequency. In this case, the depth dimension of each through hole 32 from the relief valve 35 to the compression space 25 is simply varied, whereby the depth of the through hole can be set to such a depth that when the noise goes into and out of the through hole 32, the crest and trough of the same noise wavelength cancel out each other. Moreover, when the relief valves 35 are not opened owing to the abnormal rise of the pressure in the compression space 25, the noises can be decreased in the through hole 32 from the relief valve 35 to the compression space 25. In consequence, when the depth dimension of the through hole 32 from the relief valve 35 to the compression space 25 is simply regulated, the harsh noises can be decreased, whereby suitable processability can be obtained without taking a lot of troubles.

It is to be noted that in the embodiments, the scroll compressor C of an internal low pressure type has been described, but the present invention is not limited to the scroll compressor C of the internal low pressure type, and is valid even when applied to a scroll compressor of an internal high pressure type, a rotary compressor or the like.

Moreover, in the embodiments, the shape, dimension and the like of the scroll compressor C have been described, but needless to say, the shape or the dimension may be varied without departing from the scope of the scroll compressor. C. Needless to say, the present invention is not limited to the above embodiments, and is valid even when various alterations are performed without departing from the scope of the present invention.

What is claimed is:

1. A scroll compressor comprising a sealed container in which a scroll compression element and an electromotive element to drive the scroll compression element are provided, the scroll compression element being constituted of a fixed scroll including a spiral lap vertically provided on the surface of a panel board, and a swingable scroll including a spiral lap vertically provided on the surface of a panel board and swiveled by a rotary shaft of the electromotive element with respect to the fixed scroll, the scroll compressor being configured to discharge, to a discharge pressure space in the sealed container, a refrigerant compressed by gradually reducing, from the outside to the inside, a plurality of compression spaces formed by engaging both the laps with each other, the scroll compressor further comprising:

through holes formed in the fixed scroll to connect the compression spaces to the discharge pressure space; and normally closed relief valves provided in the fixed scroll on the side of the discharge pressure space to open and close the through holes, a depth dimension of each of the through holes being set to a value corresponding to the wavelength of a noise peak frequency.

2. The scroll compressor according to claim 1, further comprising:

depressed portions formed in the surface of the fixed scroll on the side of the discharge pressure space, wherein the relief valves are disposed in the depressed portions, and the depth dimension of each of the through holes is set to a value which is ¼ of the wavelength of the noise peak frequency.

3. The scroll compressor according to claim 2, wherein the through holes are formed at two positions which are point-symmetric with respect to the center of the fixed scroll, and the depressed portions formed so as to correspond to the through holes, respectively, extend in a direction crossing, at right angles, the center line of the fixed scroll passing the centers of the through holes, respectively.

4. The scroll compressor according to claim 2, wherein each of the relief valves is constituted of a valve attached to the inside of the depressed portion, and a spring which constantly urges the valve in such a direction as to close the through hole.

5. The scroll compressor according to any one of claims 1 to 4, wherein the relief valves open the through holes during the excessive compression of the scroll compression element.

6. The scroll compressor according to any one of claims 1 to 4, wherein the relief valves open the through holes during the liquid compression Of the scroll compression element.

* * * * *